US007753653B2

(12) United States Patent
Cairo et al.

(10) Patent No.: US 7,753,653 B2
(45) Date of Patent: Jul. 13, 2010

(54) COMPOSITE INLET GUIDE VANE

(75) Inventors: Ronald R. Cairo, Greer, SC (US); Jianqiang Chen, Greer, SC (US)

(73) Assignee: General Electric Company, Schenectady, NY (US)

( * ) Notice: Subject to any disclaimer, the term of this patent is extended or adjusted under 35 U.S.C. 154(b) by 754 days.

(21) Appl. No.: 11/652,473

(22) Filed: Jan. 12, 2007

(65) Prior Publication Data

US 2008/0170943 A1 Jul. 17, 2008

(51) Int. Cl.
*F01D 5/28* (2006.01)

(52) U.S. Cl. ..... 416/224; 416/229 A; 416/230; 416/241 A; 415/200

(58) Field of Classification Search ..... 416/224, 416/229 A, 230, 241 A; 415/200
See application file for complete search history.

(56) References Cited

U.S. PATENT DOCUMENTS

| | | | | | |
|---|---|---|---|---|---|
| 3,572,971 | A * | 3/1971 | Seiwert | 416/230 |
| 3,600,103 | A * | 8/1971 | Gray et al. | 416/154 |
| 3,762,835 | A * | 10/1973 | Carlson et al. | 416/224 |
| 3,887,297 | A * | 6/1975 | Welchek | 415/161 |
| 4,022,540 | A | 5/1977 | Young | |
| 4,594,761 | A * | 6/1986 | Murphy et al. | 29/889.71 |
| 5,098,797 | A | 3/1992 | Haskell | |
| 5,260,099 | A * | 11/1993 | Haskell | 427/367 |
| 5,486,096 | A * | 1/1996 | Hertel et al. | 416/224 |
| 7,121,727 | B2 | 10/2006 | Bruce et al. | |
| 7,156,622 | B2 * | 1/2007 | Schreiber | 416/224 |

* cited by examiner

*Primary Examiner*—Igor Kershteyn
(74) *Attorney, Agent, or Firm*—Nixon & Vanderhye, P.C.

(57) ABSTRACT

A composite vane includes an airfoil portion having an inner core composed primarily of fiberglass epoxy; a carbon epoxy fabric located outward of the inner core; a relatively thin layer of fiberglass epoxy, and an outer metal sheath.

15 Claims, 6 Drawing Sheets

COMPOSITE INLET GUIDE VANE

This invention relates to inlet guide vanes for compressors, and more specifically, to a composite vane constructed of multiple materials.

BACKGROUND OF THE INVENTION

Current inlet guide vanes (or IGVs) are typically fabricated from GTD 450 precipitation-hardened stainless steel. Such vanes are subject to in-service distress in the form of wear and corrosion pitting-induced high cycle fatigue in the spindle area of the vane and corrosion pitting in the airfoil portion of the vane.

BRIEF DESCRIPTION OF THE INVENTION

In one exemplary but non-limiting embodiment, there is provided an inlet guide vane (IGV) that is designed primarily on the basis of material compatibility, i.e., in accordance with a design philosophy that makes use of multiple materials strategically placed to take advantage of their most attractive attributes to solve specific challenges. For example, the majority of the cross-section of the airfoil portion of the vane, i.e., the inner core of the vane, may be composed primarily of fiberglass epoxy for its high static and fatigue strength and low cost. Carbon epoxy fabric is strategically placed in other areas of the airfoil portion requiring bi-directional stiffness, e.g., in areas close to the air passage surfaces for maximum flexural rigidity for frequency and displacement control, preferably comprising about 20% by volume of the airfoil portion of the blade. A relatively thin layer of fiberglass epoxy may be placed between the carbon epoxy fabric and the outer sheath.

The airfoil portion is covered by an outer metal sheath, preferably aluminum, for foreign object damage (FOD) and corrosion, erosion and moisture resistance. The sheath may be in the form of a discrete solid wrap bonded to the fiberglass epoxy, or in the form of an applied aluminum coating.

The vane airfoil is also formed with an integral, radially-inwardly projecting tab by which the airfoil is attached at its radially inner end to the spindle (or mounting) portion of the blade. The tab itself is also formed in a composite manner, with an extension of the epoxy fiberglass inner core sandwiched between extensions of the outer sheath.

Accordingly, in one aspect, the invention relates to a composite vane comprising an airfoil portion having an inner core composed primarily of fiberglass epoxy and an outer metal sheath surrounding the inner core.

In another aspect, the invention relates to a composite vane comprising an airfoil portion having an inner core composed primarily of fiberglass epoxy and an outer metal sheath surrounding the inner core, wherein the airfoil portion is further comprised of about 20% by volume of carbon/epoxy fabric located in selected areas of the airfoil portion outwardly of the inner core, and wherein additional fiberglass epoxy material is interposed between the carbon/epoxy fabric and the aluminum sheath.

The invention will now be described in detail in connection with the drawings identified below.

DETAILED DESCRIPTION OF THE INVENTION

Figure 1:
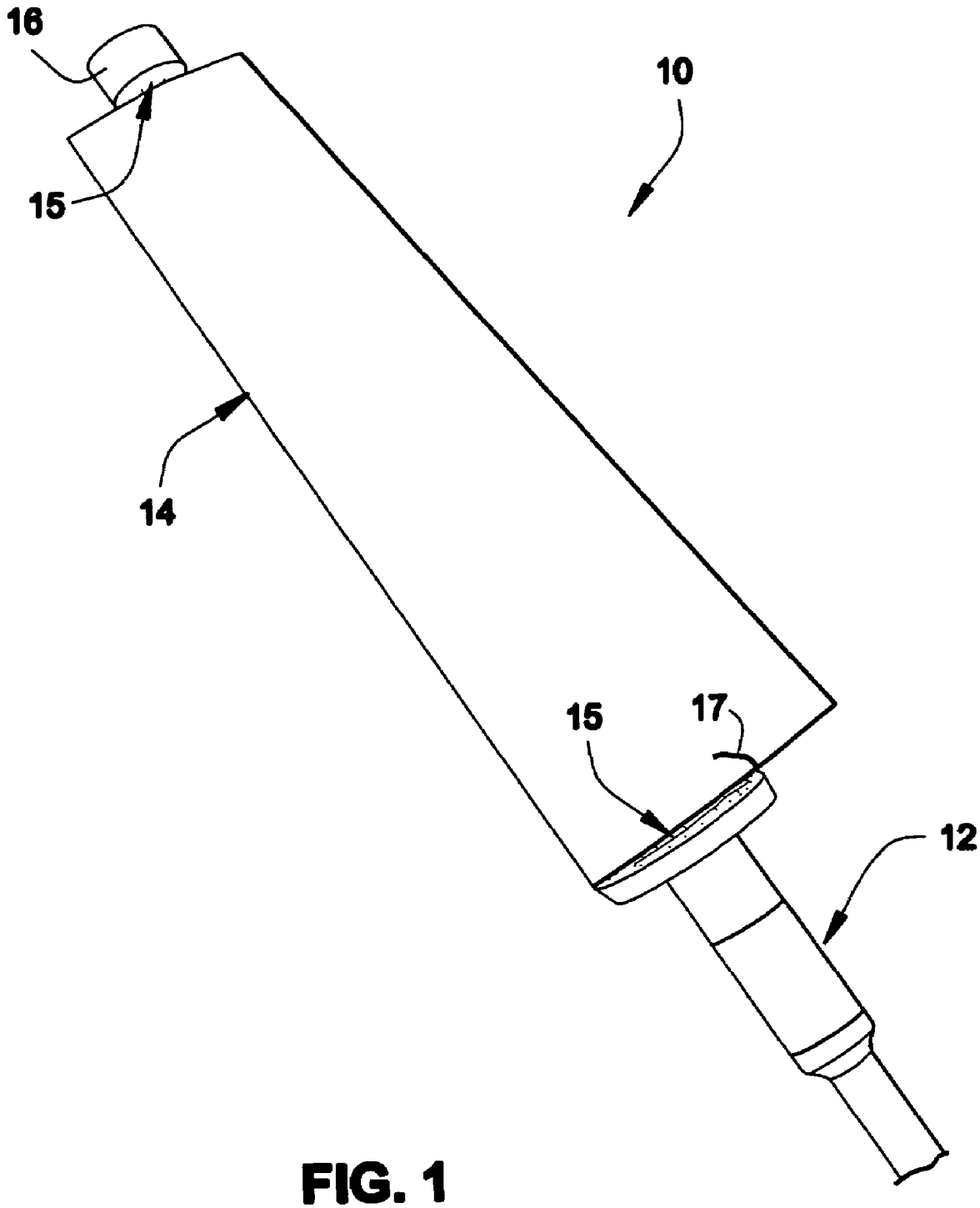
FIG. 1 (PRIOR ART)
FIG. 1 is a perspective view of a conventional inlet guide vane.

FIG. 1 illustrates an inlet guide vane 10 that includes a spindle portion 12, an airfoil portion 14, and a radially outer trunnion 16. This is a typical and well-known inlet guide vane construction that may be subject to corrosion pitting at the base of the airfoil portion 14 indicated at 15 as well as corrosion pitting induced high cycle fatigue cracks, one indicated at 17.

Figure 2:
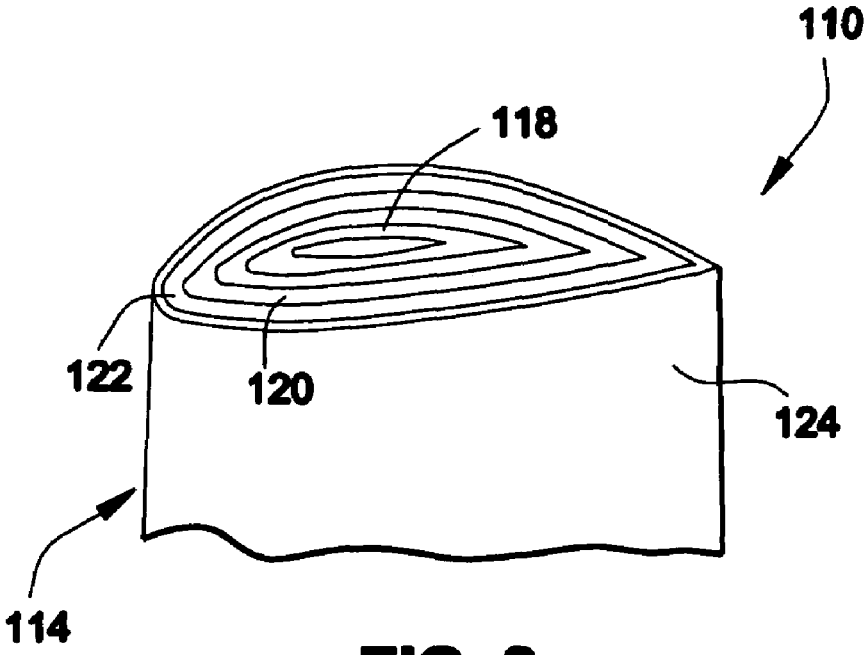
FIG. 2 is a partial perspective view of an inlet guide vane of the type described herein.
Figure 3:
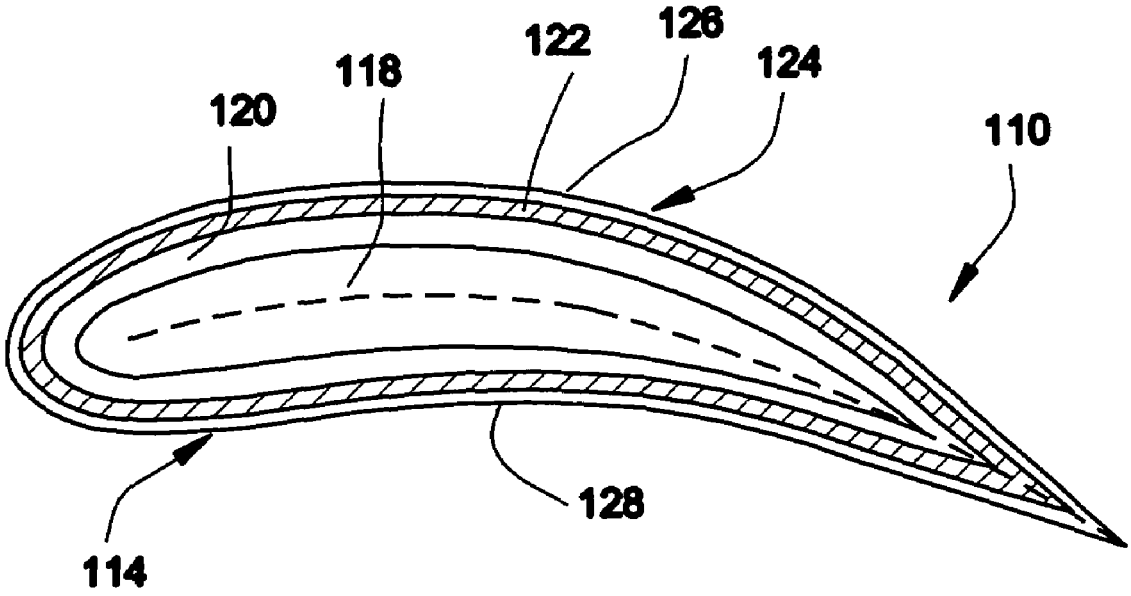
FIG. 3 is a plan view of the inlet guide vane as shown in FIG. 2.

FIGS. 2 and 3 illustrate a composite guide vane in accordance with an exemplary but non-limiting embodiment of this invention. The vane 110 also includes an airfoil portion 114 and spindles and trunnions (not shown) similar to those shown in FIG. 1. The spindles and trunnions are metallic for robust, wear-resistant, interfaces. In this embodiment, however, at least the airfoil portion 114 is comprised of a composite incorporating a wrapped fiber glass epoxy inner core 118 surrounded by a carbon epoxy fabric 120 that is in turn wrapped in a metal sheath (or, alternatively, a coating) 124. The preferred metal is aluminum that may itself be coated with a phosphate/chromate sealer to enhance surface finish and extend the long term corrosion protection.

More specifically, the inner core 118 is comprised of an economical, continuous-reinforced fiberglass epoxy, having high tensile (and span-wise) strength and fatigue life. As is readily apparent from FIGS. 2 and 3, the fiberglass epoxy material takes up the majority of the interior space of the airfoil portion.

Note that the continuous fiber reinforced carbon epoxy fabric 120 that surrounds the inner core 118 is placed in close proximity to the air passage surfaces 126, 128 (FIG. 3) of the airfoil portion 114. The carbon epoxy fabric 120 is selected for its bidirectional stiffness and strength properties, and comprises between about 15-30% (for example 20%) of the volume of the airfoil portion 14. The fiber orientation of the fabric is radial chordwise and ±450° to balance torsional and flexural requirements, or span-wise/chord-wise for maximum flexural stiffness. The number of layers is determined by design requirements.

A relatively thin layer of fiberglass epoxy material 122 encloses or surrounds the continuous reinforced carbon epoxy fabric 120, i.e., sandwiched between the fabric 120 and the metal sheath 124.

The outer aluminum sheath 124 may be on the order of 0.010 inch thick which provides protection against foreign object damage, erosion, corrosion, while enhancing moisture resistance. The sheath may be epoxy-bonded to the fiberglass epoxy layer 122, and co-cured with the fiberglass and carbon epoxy layers. Solution-hardened Series 3000 aluminum (for example, 3004 aluminum) is suitable for the solid sheath. The latter may also be strain-hardened up to 50 Ksi in UTS. This material has excellent corrosion resistance in aqueous media when the pH is between 4.0-8.5. The sheath may be folded from a flat sheet or preformed to airfoil shape in a die.

Alternatively, a cold-spray-deposited 7000 series aluminum coating may be applied over the outer fiberglass epoxy layer 122. Cold-spray aluminum is in nano-crystalline microstructure form, with increased surface hardness, superior corrosion resistance, and good fatigue and fracture toughness. The coating process can produce conventional (1-50 μm particles) and a layer with increased surface hardness and therefore wear resistance. Al—Zn—Mg—Cu—Zr or Al—Si—Fe—Ni are alloys of choice for the coating.

The aluminum sheath or coating 124 may be, in turn, coated with a phosphate-chromate sealer to enhance surface finish and extend the long term corrosion protection.

Figure 4:
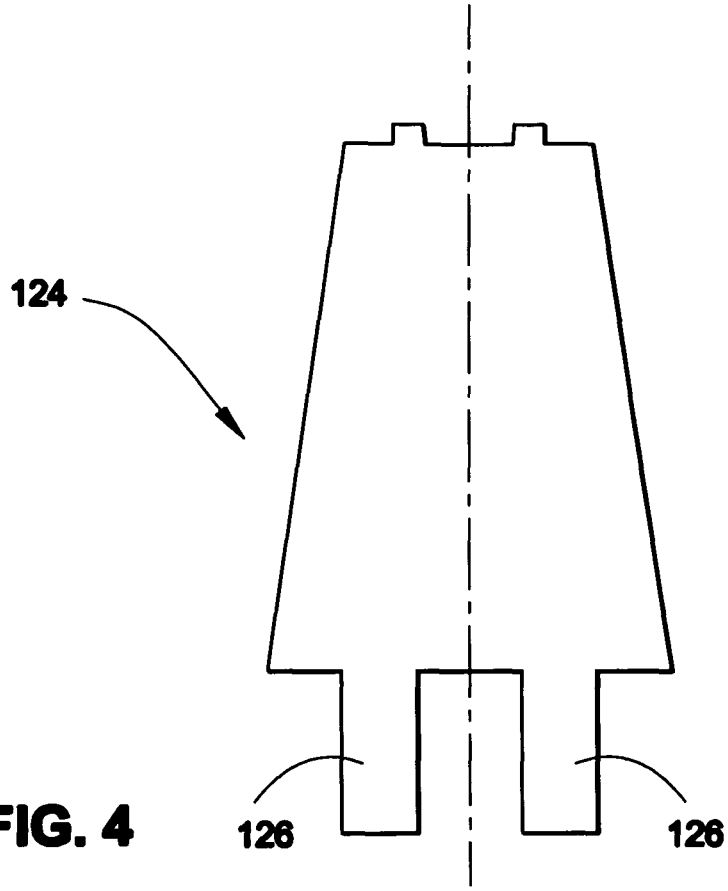
FIG. 4 is a side elevation of an exterior metal sheath, unfolded in intermediate stock form, for use with the inlet guide vanes is shown in FIGS. 2 and 3.
Figure 5:
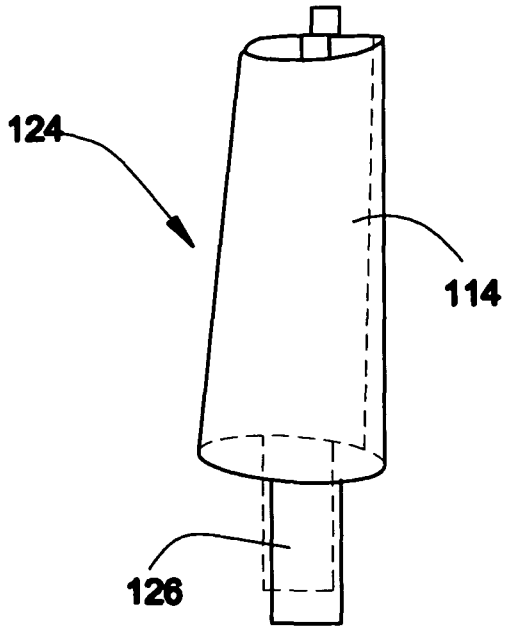
FIG. 5 is a side elevation of the stock shown in FIG. 4 but in a folded condition.
Figure 6:
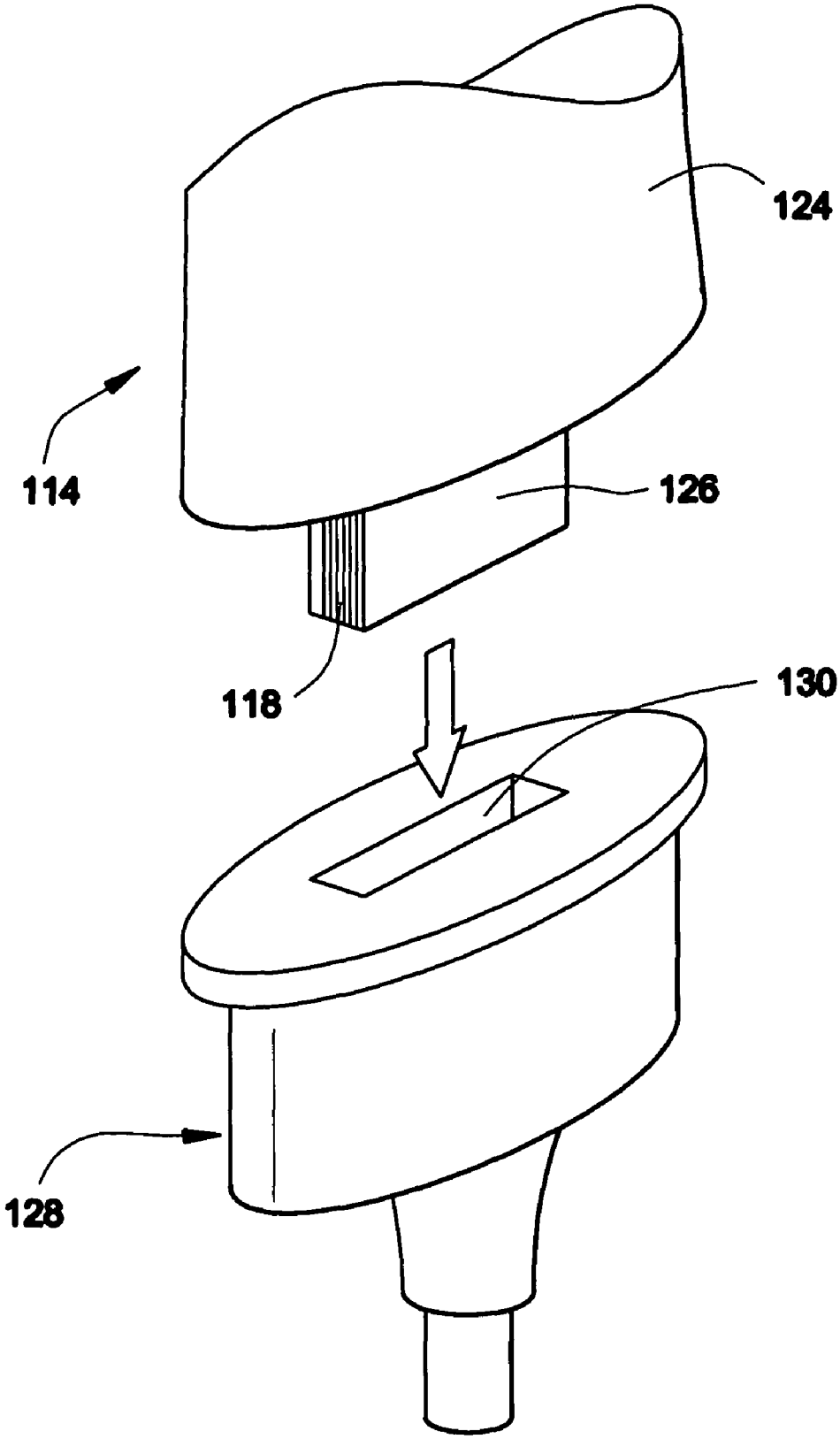
FIG. 6 is an exploded partial perspective view illustrating assembly of composite airfoil portion of a guide vane constructed in accordance with the exemplary embodiment to a spindle portion of a vane.
Figure 8:
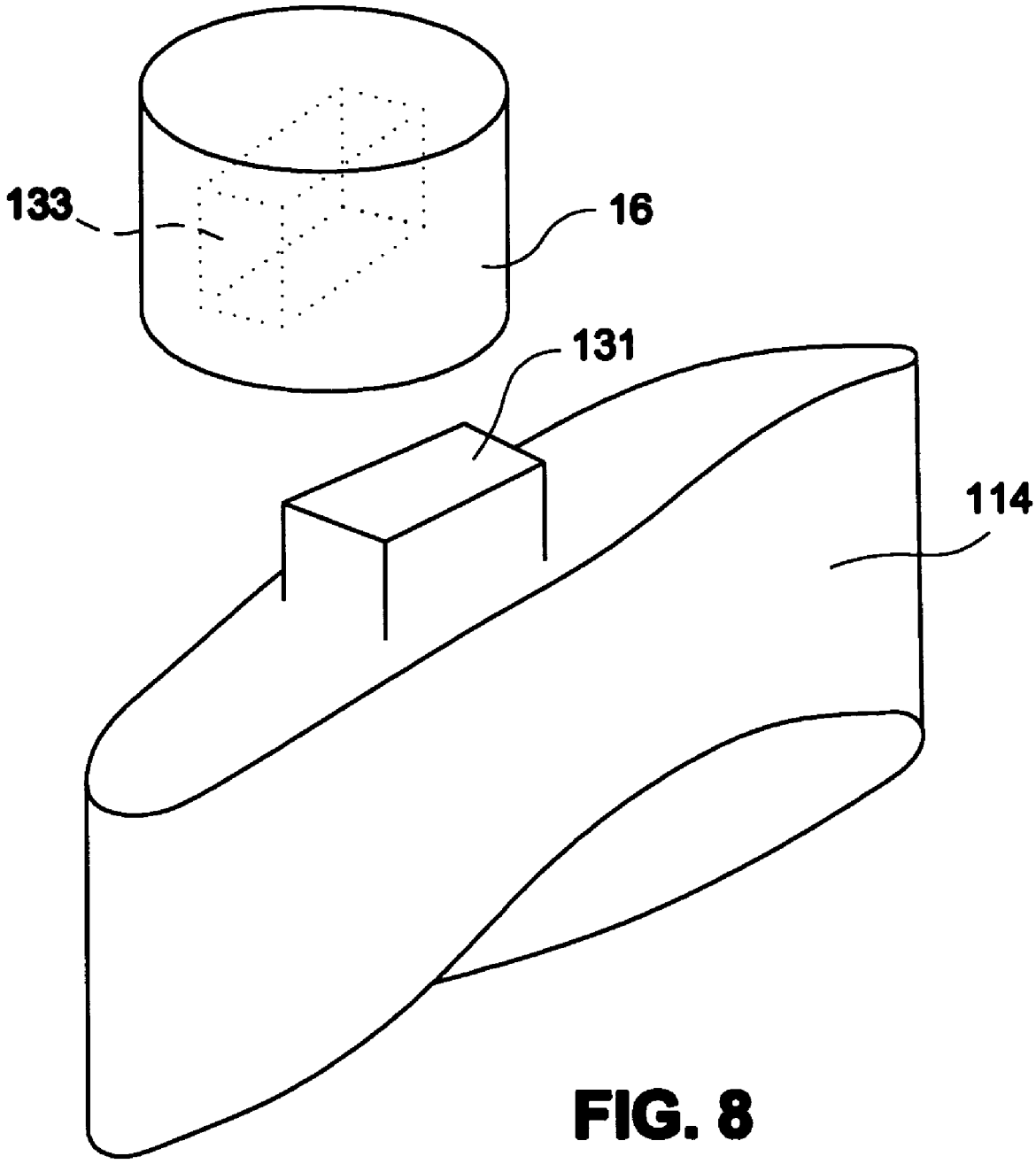
FIG. 8 is an exploded partial perspective view illustrating assembly of the composite airfoil portion to a trunnion.

Referring now to FIGS. 4 and 5, and in the event the aluminum is applied in the form of a sheath as opposed to a coating, a pair of radially extending tabs 126 maybe formed integrally at the base of the airfoil portion 114 so that, when aligned (as shown in FIGS. 5 and 6), the tabs 126 will be sandwiched about a similarly extended tab portion of the fiberglass epoxy core 118. As shown in FIG. 6, the tabs 126 are sized and shaped to fit in a mating recess 130 formed in a spindle 128 and epoxy-bonded thereto. The rectangular cross-section of the tabs facilitates transmission of torque for the actuation of the inlet guide vane. A similar arrangement, as shown in FIG. 8, may be adopted at the opposite end of the blade where the airfoil portion 114 joins the trunnion 16, with a composite tab 131 fitted to a mating recess 133 in the trunnion.

Figure 7:
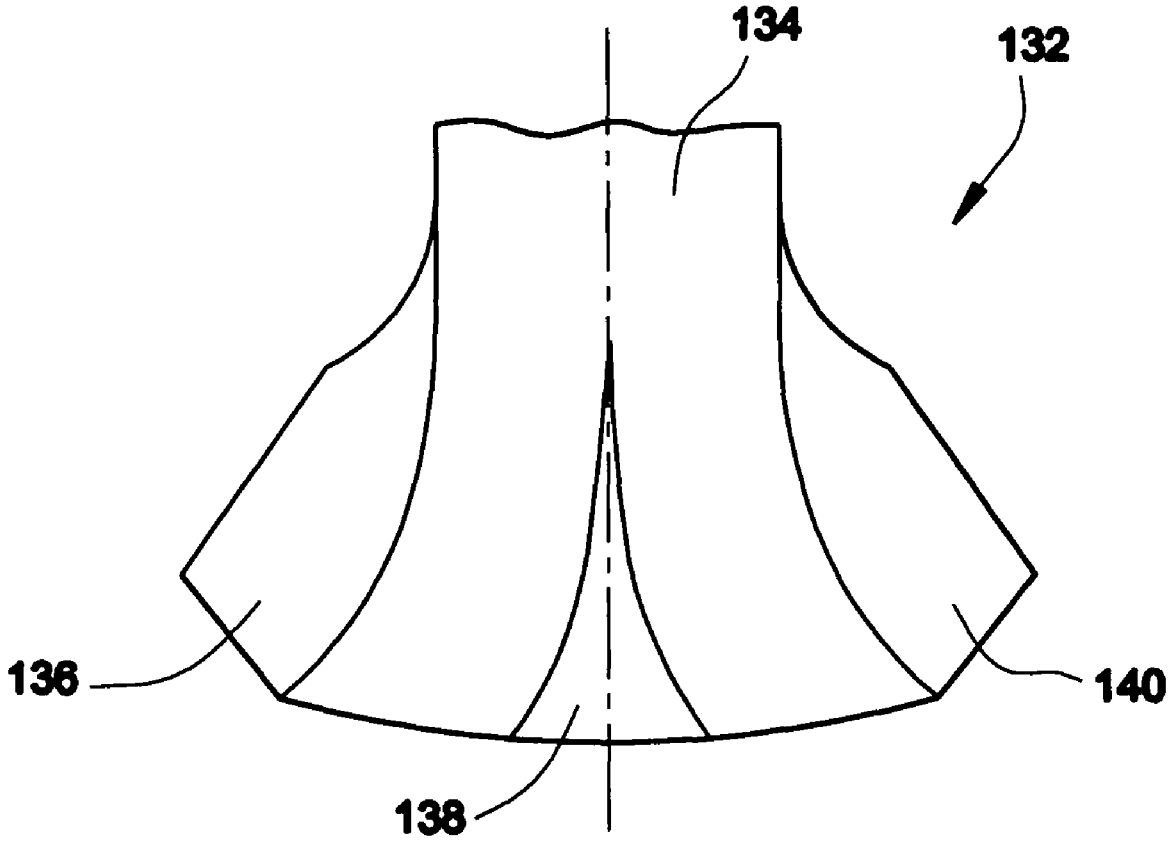
FIG. 7 is a partial end view of an alternate tab construction for the guide vanes shown in FIGS. 2-6.

An alternative tab arrangement is shown in FIG. 7 where the lower ends of the tabs 134 are shaped to provide a dovetail connection with the spindle, the tabs 134 having a wedge-shaped inner core 138 of metal (i.e. aluminum) that splays, or bifurcates, the fiberglass core layers,118, and outer carbon/epoxy fabric layers, 120. As before, the entire assembly is covered with the metal (i.e. aluminum) sheath, 124, extensions 136, 140.This termination engages a mating geometry slot in the spindle, 128.

The blade described herein is primarily intended for use as a compressor inlet guide vane, experiencing service temperatures up to about 250° F. The composite construction is suitable for other vanes, and including solid, rotating blades, with appropriate changes in material, depending on service temperatures.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A composite vane comprising an airfoil portion having an inner core composed primarily of fiberglass epoxy: said inner core surrounded by a continuous fiber reinforced carbon epoxy fabric; said continuous fiber reinforced carbon epoxy fabric surrounded by a fiberglass epoxy layer and an outer metal sheath bonded to said fiberglass epoxy layer.

2. The composite vane of claim 1 wherein said airfoil portion is comprised of between about 15-30% by volume of said carbon/epoxy fabric.

3. The composite airfoil of claim 2 wherein said outer metal sheath comprises aluminum.

4. The composite airfoil of claim 2 wherein said outer metal sheath comprises an aluminum coating.

5. The composite vane of claim 2 wherein fiber orientation in said carbon/epoxy fabric is radial chord-wise ±45°.

6. The composite vane of claim 1 wherein said vane comprises a compressor inlet guide vane.

7. The composite vane of claim 2 wherein said carbon/epoxy fabric is located nearer peripheral external surfaces of said airfoil than to a center of said inner core.

8. The composite vane of claim 3 wherein said aluminum sheath has a thickness of about 0.010 inch.

9. The composite vane of claim 1 wherein said metal sheath is comprised of cold-spray-deposited 7000 series aluminum.

10. The composite vane of claim 3 wherein said aluminum sheath is coated with a phosphate/chromate sealer.

11. The composite vane of claim 1 and further comprising a spindle attached to said airfoil portion.

12. A composite vane comprising an airfoil portion having an inner core composed primarily of fiberglass epoxy and an outer metal sheath surrounding said inner core, and further comprising a spindle attached to said airfoil portion and wherein said airfoil portion is formed at its radially inner end with a tab adapted to be received in a recess provided in said spindle and wherein said tab is comprised of a pair of aluminum tab portions on either side of a fiberglass epoxy tab portion and wherein said aluminum and fiberglass epoxy tab portions have a rectangular cross-sectional shape.

13. A composite vane for a compressor comprising an airfoil portion having an inner core composed primarily of fiberglass epoxy and an outer metal sheath, wherein said airfoil portion is further comprised of about 20% by volume of carbon/epoxy fabric located in selected areas of said airfoil portion outwardly of said inner core, and wherein additional fiberglass epoxy material is interposed between said carbon/epoxy fabric and said outer metal sheath; and wherein said airfoil portion is formed at its radially inner end with a composite tab adapted to be received in a pocket provided in said spindle, said composite tab comprising fiberglass epoxy sandwiched between extensions of said outer metal sheath.

14. The composite airfoil of claim 13 wherein said outer metal sheath comprises aluminum.

15. The composite airfoil of claim 13 wherein said outer metal sheath comprises an aluminum coating.

* * * * *